US009198506B2

(12) United States Patent
Flanet

(10) Patent No.: US 9,198,506 B2
(45) Date of Patent: Dec. 1, 2015

(54) DEVICE FOR REMOVABLY ATTACHING A WORK SPACE DIVIDING PARTITION TO AN OFFICE WORK SURFACE

(75) Inventor: Daniel Flanet, Schiltigheim (FR)

(73) Assignee: Steelcase S.A., Schiltigheim (FR)

( * ) Notice: Subject to any disclaimer, the term of this patent is extended or adjusted under 35 U.S.C. 154(b) by 0 days.

(21) Appl. No.: 14/366,993

(22) PCT Filed: Dec. 19, 2011

(86) PCT No.: PCT/FR2011/053053

§ 371 (c)(1),
(2), (4) Date: Jun. 19, 2014

(87) PCT Pub. No.: WO2013/093215

PCT Pub. Date: Jun. 27, 2013

(65) Prior Publication Data

US 2014/0345502 A1 Nov. 27, 2014

(51) Int. Cl.

| | |
|---|---|
| ***A47B 13/00*** | (2006.01) |
| ***A47B 83/04*** | (2006.01) |
| *E04B 2/74* | (2006.01) |

(52) U.S. Cl.

CPC ..... *A47B 13/00* (2013.01); *A47B 83/04* (2013.01); *E04B 2002/7483* (2013.01)

(58) Field of Classification Search

CPC ..... E04B 2002/7483; A47B 57/58; A47B 57/583; A47B 57/00; A47B 96/04; A47B 83/04

USPC ..... 108/60, 61

See application file for complete search history.

(56) References Cited

U.S. PATENT DOCUMENTS

| | | | | | |
|---|---|---|---|---|---|
| 436,704 | A | * | 9/1890 | Green | 108/61 |
| 607,890 | A | * | 7/1898 | Smith | 211/184 |
| 607,891 | A | * | 7/1898 | Smith | 211/184 |
| 4,190,167 | A | * | 2/1980 | Wells et al. | 211/184 |
| 5,486,042 | A | | 1/1996 | Heisler et al. | |
| 5,655,670 | A | * | 8/1997 | Stuart | 211/43 |
| 6,119,992 | A | * | 9/2000 | Stuart | 248/231.71 |
| 2014/0038164 | A1 | * | 2/2014 | Battey | 434/365 |

FOREIGN PATENT DOCUMENTS

| | | | |
|---|---|---|---|
| DE | 19636280 | A1 | 10/1997 |
| DE | 202006015991 | U1 | 2/2008 |
| GB | 2204479 | A | 11/1988 |
| WO | 2004021829 | A1 | 3/2004 |
| WO | 2006003008 | A1 | 12/2006 |

OTHER PUBLICATIONS

International Search Report, PCT/FR2011/053053, Jun. 24, 2014, 8 pages.

* cited by examiner

*Primary Examiner* — Daniel Rohrhoff
(74) *Attorney, Agent, or Firm* — Price Heneveld LLP

(57) ABSTRACT

Workspace dividing partition resting via a lower edge on the top face of a wall forming a work surface and incorporating a device for attaching the partition to the work surface. The partition includes placement means comprising a translationary mobile branch which with the lower edge of the partition forms a clamp type mechanism situated on either side of an external overhang of the work surface, wherein the branch is able to move between a position in which it presses with contact against the underside of the work surface in order to attach the partition, and a position distant from the underside in order to release the partition. The partition also includes placement control means, situated near the overhang and reproducing, in a direction appearing parallel to the work surface, the movement and positioning of the mobile branch with respect to the work surface.

21 Claims, 5 Drawing Sheets

DEVICE FOR REMOVABLY ATTACHING A WORK SPACE DIVIDING PARTITION TO AN OFFICE WORK SURFACE

BACKGROUND OF THE INVENTION

The invention concerns a device for the removable attachment of a work space dividing partition to an office work surface. These partitions, also known under the name of dividers or screens, are generally used in open-space environments, so as to create several work spaces.

These partitions thus allow a person's work space to be defined with respect to the work spaces of his neighboring colleagues.

Each person can then benefit from a more confined area affording more privacy and sometimes even soundproofing, and enabling, furthermore, better concentration.

Until now, these partitions have been attached to office work surfaces by clamping collets or have been placed on the work surfaces by clamping chucks, or have been supported by legs resting directly on the ground.

The solutions based on clamping chucks or legs are cumbersome, contrary to the solutions based on clamps.

The known clamping collets present the drawback of being limited to certain work surface thicknesses. Moreover, even though their installation does not require any tools, installation is sometimes awkward.

SUMMARY OF THE INVENTION

One aspect of the present invention is to provide a device that allows the attachment of a panel which is simple to use and adapted to any work surface thickness.

To this end, the invention concerns a space dividing panel resting via a lower edge on the top surface of a wall forming the work surface and incorporating a device for attaching the panel to the work surface. It is characterized principally in that the device comprises:

- placement means comprising a translationary mobile branch forming with the lower edge of the panel a clamp type mechanism located on either side of an external overhang of the work surface, the branch being movable between a position in which it presses with contact against the underside of the work surface for attachment of the panel, and a position at a distance from the surface for releasing the panel;
- control means of the placement means, located in the vicinity of the overhang, and reproducing, in a direction running parallel to the work surface, the displacement and the positioning of the mobile branch with respect to the work surface.

Specifically, when the mobile branch is moved away from the work surface (respectively towards the work surface), the control device is also. There is a correspondence, therefore, between the movement of the mobile branch and the movement of the control means.

More precisely, the attachment device comprises:

- at least one support surface at the level of the lower edge of the panel on the top face of the work surface;
- a vertical flange provide with a placement end corresponding to the mobile branch and angled at 90° with respect to the flange, the flange being mobile in vertical translation, bringing the placement end away from or against the underside of the work surface in order to respectively release the panel or to attach it to the work surface;
- an actuating member of the flange corresponding to the means of control, movable in horizontal translation between an actuating position at a distance from the work surface where the placement end of the flange is at a distance from the work surface, and a releasing position in the vicinity of the work surface where the placement end of the flange rests against the underside of the work surface;
- means for returning the actuating member from the actuating position to the release position;
- means for transforming the horizontal movement of the actuating member into the vertical movement of the flange.

This solution features the advantage that, due to these transformation means, the attachment of the panel is made by a simple actuating of the actuating member by the user.

Specifically, the user first pulls on the actuating member to displace it horizontally toward an actuating position, thus bringing about the descent of the flange. It is then possible to correctly position the panel in relation to the edge of the work surface. The user then releases the actuating member, the latter being returned toward a release position, bringing about the raising of the flange until its placement end comes to rest against the underside of the work surface. The work surface is then held tight between the support surface of the panel, on the one hand, and the placement end of the flange, on the other hand.

The support surface of the panel and the placement end of the flange act as a jaw controlled by the actuating member. The opening (respectively the closing) of this jaw is produced by the movement of the placement end of the flange downwards by pulling on the actuating member (respectively upward by releasing the actuating member).

The attachment of the panel is therefore nearly instantaneous and can be performed by one person easily, in a single movement, and without tools, for any type of work surface thickness.

More precisely, the actuating and releasing positions are defined relatively with respect to the thickness of the work surface. The thicker the work surface, the more the jaw must open up to grip the edge of the work surface, and therefore the more considerable the horizontal movement of the actuating member will be, and inversely. Consequently, the so-called actuating and releasing positions are different depending on whether the work surface is thicker or thinner.

In the absence of the work surface, the movement of the actuating member is limited by stops corresponding to the maximum actuating and the maximum releasing positions.

According to the invention, the transformation means consist of a ramp belonging to the actuating member, inclined at an angle of $\alpha=]0; \pi/2[$ with respect to the horizontal, and inserted in the interior of an opening made in the flange, the horizontal displacement of the ramp causing the vertical displacement of the flange.

The ramp is of a uniform width and is mounted fitted in the opening of the flange, the opening being specially sized to receive this ramp width. The opening receives the upper portion of the ramp when the actuating member is in maximum releasing position with the flange in raised position, and receives the lower portion of the ramp when the actuating member is in the maximum actuating position with the flange in lowered position.

The actuating of the actuating member from its maximum releasing position to its maximum actuating position leads to the sliding of the ramp within the opening, from its upper portion towards its lower portion, the $\alpha$ angle being negative in this case. The intersection between the lower edge of the opening and the lower edge of the ramp brings the flange downward while the ramp is displaced horizontally, due to this negative inclination of the ramp with respect to the horizontal.

Upon the release of the actuating member, the ramp slides within the opening, from its lower portion towards its upper portion, the $\alpha$ angle being positive in this case. The intersection between the upper edge of the opening and the upper edge of the ramp brings the flange upwards while the ramp is displaced horizontally, due to this positive inclination of the ramp with respect to the horizontal.

In order for the system to work, the ramp must not be horizontal ($\alpha=0$) in which case there would be no vertical movement of the flange. The ramp must not be vertical ($\alpha=\pi/2$), in which case it could not be inserted into the opening of the flange.

In order to ensure the horizontal displacement of the actuating member, the attachment device features guiding means of the actuating member within the panel. In fact, if the actuating member is moved from an angle $\alpha$ with respect to the horizontal, there will be no vertical drive of the flange.

Preferably, these guiding means consist of slide links. More precisely, the actuating member is composed of three parts:

- A vertical part sliding horizontally in a groove made in a fixed lower support of the panel;
- The ramp sliding inside of the opening made in the mobile flange;
- A horizontal part featuring at least one horizontal slide inside of which at least two bolts of a fixed intermediate support of the panel are inserted, with the position of the bolts within the slide dependent on the horizontal movement of the actuating member.

The horizontality of the actuating member is ensured by the bolts/slide unit arranged horizontally. The bolts form two horizontal fixed points preventing any rotation of the actuating member, and limiting its movement in a horizontal direction by means of the slide.

Furthermore, to improve the sliding between the ramp and the flange, the flange features guide fins of the ramp, positioned at a same angle $\alpha$ with respect to the horizontal. These fins, featuring the same inclination as the ramp, increase the contact surface between the edges of the ramp and the flange, thus limiting friction localized at the upper and lower edges of the opening in the flange so as to prevent premature localized wear of the mechanism.

In addition to the guiding means of the actuating member within the panel, the attachment device per the invention features guiding means of the flange within the panel, allowing the verticality of the movement of the flange to be ensured.

These guiding means are located on both the upper and lower parts of the flange. In order to do this, the upper part of the flange passes through a guide opening made in the upper support of the panel, while the lower part of the flange is guided on either side between a vertical side of said lower support of the panel and a vertical side of a fixed element of the panel.

Optionally, a centering clip of the flange is inserted into the guide opening of the upper support of the panel. This clip may take any form possible.

Furthermore, the flange features a shoulder in its upper part, acting as a stop with respect to the upper support of the panel, thus limiting its vertical displacement towards the top of the panel, so that it doesn't strike against a finishing cover covering the upper support of the panel.

According to one possible configuration, the means for return of the actuating member consist of a spring of which a first end is attached to the actuating member and a second end is attached to a fixed element of the panel. Other return means could be used.

Generally, the panel is composed of two facing plates forming front and rear faces, the plates being connected by the upper and lower supports and by a first mount and a second mount arranged symmetrically at the lower ends of the panel in contact with the work surface, with the lower surfaces of the mounts corresponding to the support surfaces of the panel on the upper face of the work surface. Providing two support surfaces (rather than one) at the two ends of the panel allows it to be better stabilized on the work surface.

Practically, the first mount is located facing the placement end of the flange and constitutes the fixed element of the panel of which one of the vertical sides serves to guide the flange. This first mount thus fulfills two functions: a support function for the stability of the panel, and a guiding function for the flange.

The second mount constitutes the fixed element of the panel to which the second end of the spring is connected. It therefore also fulfills two functions: a support function for the stability of the panel, and an anchoring point function for the return means of the actuator member.

Advantageously, all of the support surfaces of the panel on the work surface are equipped with non-slip feet to prevent any sliding of the panel along the edge of the work surface and therefore to strengthen the attachment of the panel. Thus, the support surfaces of the mounts on the upper face of the work surface as well as the support surface of the placement end of the flange on the underside of the work surface are provided with non-slip feet.

According to one possibility, the free end of the vertical portion of the actuating member is provided with a gripping sleeve extending from the lower support for the manual actuating of the actuator member by a user. This gripping sleeve can take any form, with its ergonomics being adapted to the hand of the user.

DETAILED DESCRIPTION

Figure 1A:
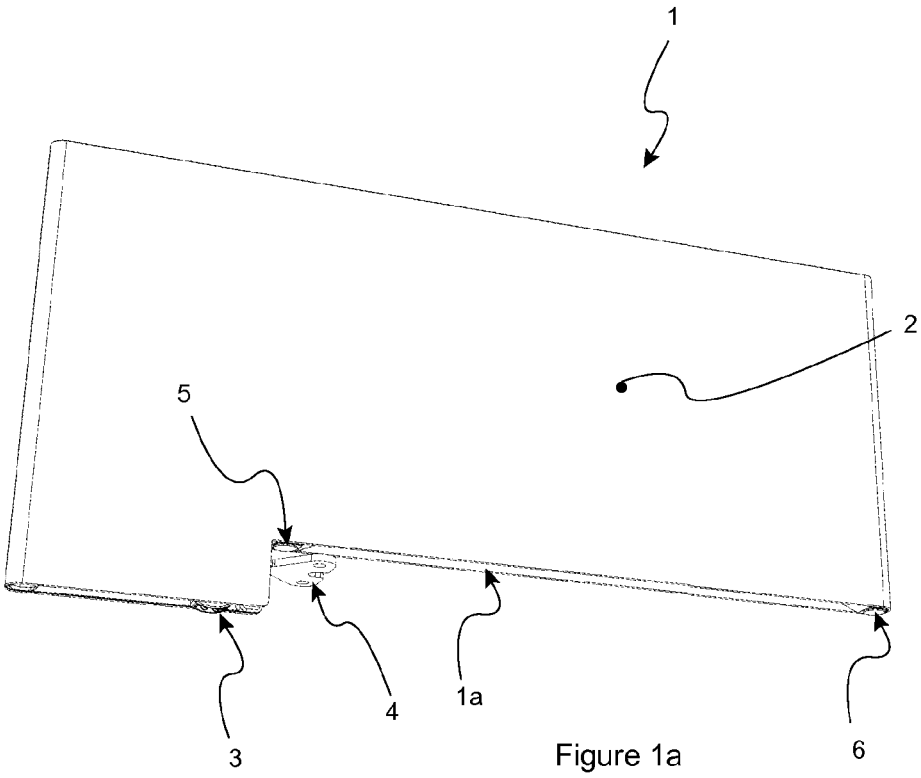
FIG. 1*a* represents the panel seen from the exterior, with the actuating member in the maximum release position, the flange being raised to its maximum position.

With reference to FIG. 1*a*, the attachment device is incorporated in a panel (1). The two facing panels (2), forming the front and rear faces of the panel (1) hide a portion of the attachment device located inside of the panel (1).

This attachment device is actuated by an actuating member (8), which causes the raising and lowering of a flange (7)

whose free end, called the placement end (4), as well as the gripping sleeve (3) of the actuating member (8), is visible from the exterior of the panel (1).

In the configuration presented in FIG. 1*a*, the actuating member (8) is in a maximum release position, i.e., in coordination with its gripping sleeve (3) wholly adhering on its right to the placement end (4). In this position, the placement end (4) is in raised position.

Figure 1B:
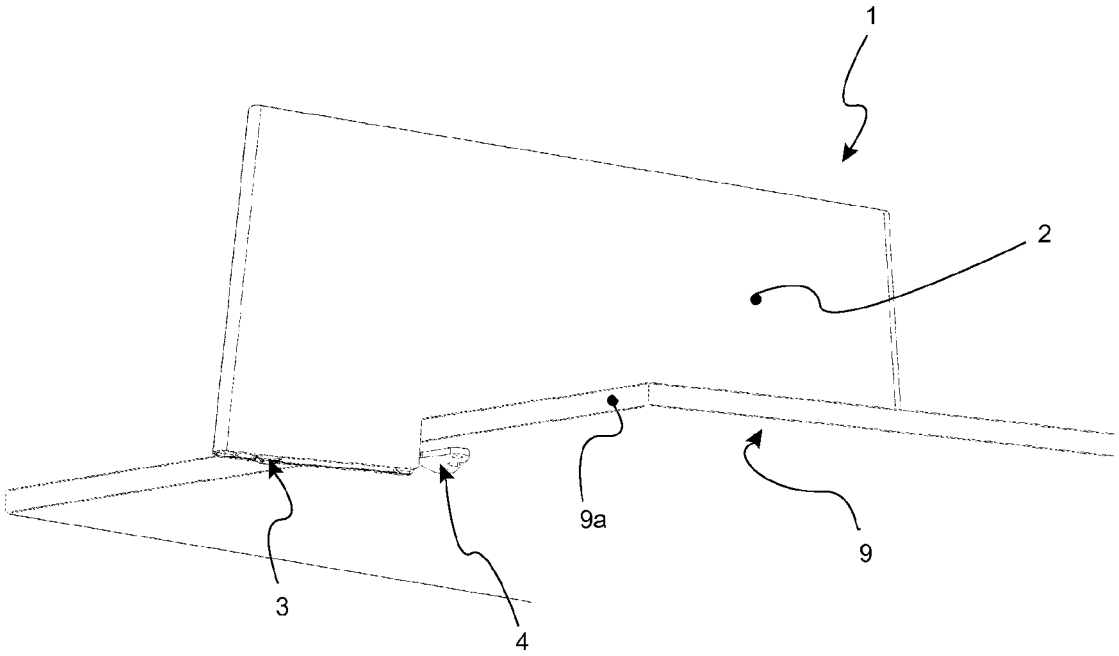
FIG. 1*b* illustrates the panel with the actuating member in the actuating position and positioned in relation to a work surface.

In the configuration presented in FIG. 1*b*, a user pulls the sleeve (3) of the actuating member (8) to move it towards a maximum actuating position, i.e. in coordination with its gripping sleeve (3) wholly adhering on its left to a corner of the panel (1). In this position, the placement end (4) is in lowered position, so as to be able to easily position the panel (1) on a work surface (9), with the placement end (4) of the flange (7) positioning itself under the work surface (9), close to its outer edge (9*a*). The panel (1) presents two supporting surfaces (5, 6) at its lower edge (1*a*), visible in FIG. 1*a*, capable of resting on the upper side of the work surface (9).

Figure 1C:
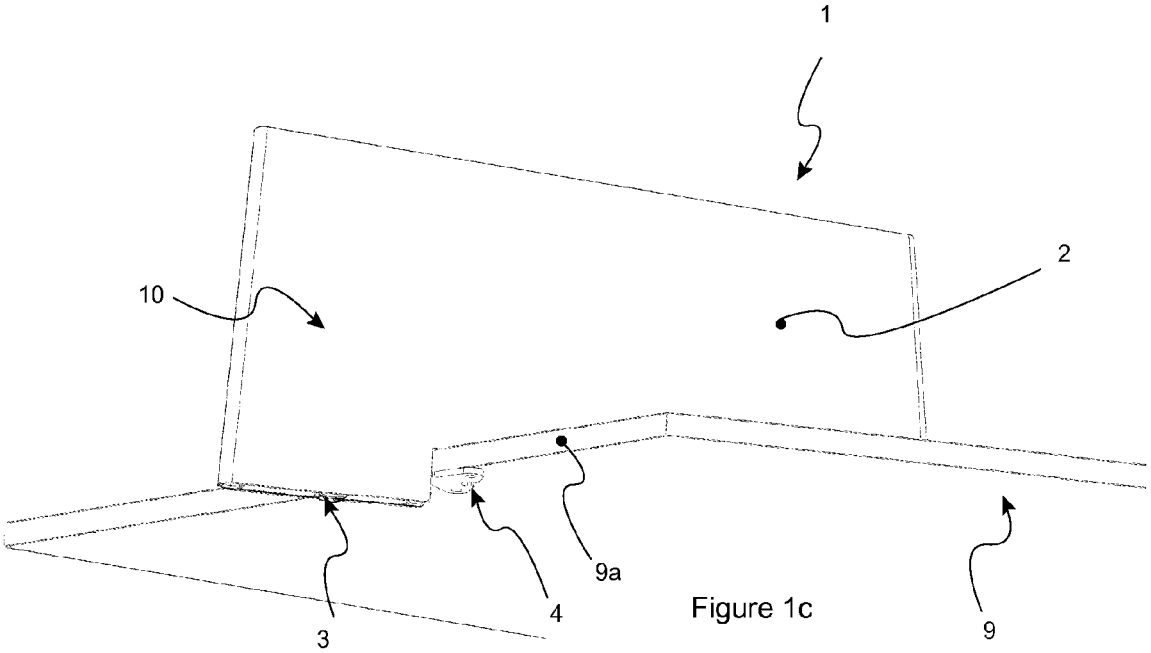
FIG. 1*c* shows the panel attached to the work surface with the actuating member in the release position.

Once the panel (1) is correctly positioned with respect to the work surface (9), the user releases the sleeve (3) of the actuating member (8). The latter is then found in the release position as illustrated in FIG. 1*c*, with the placement end (4) of the flange (7) coming to rest on the underside of the work surface (9). The panel (1) is then attached to the work surface (9).

The panel (1) has a generally rectangular shape, but it can be provided with an extension (10) located in its lower left corner as is the case on FIGS. 1*a* to 1*c*. In this case, the gripping sleeve (3) extends from the extension (10) in a downward direction in order to be easily accessible by the user, and the placement end (4) extends from the left side of the extension (10) which is facing the edge of the work surface (9).

Figure 2:
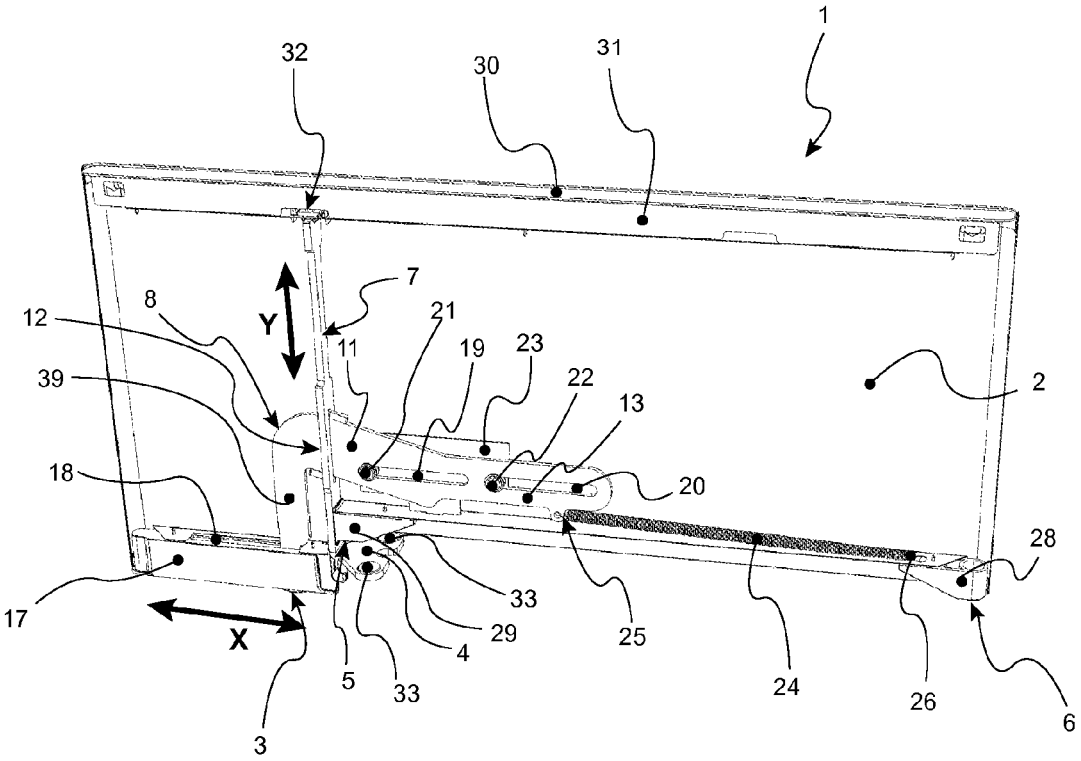
FIG. 2 represents the attachment device with the actuating member in the maximum release position.
Figure 3:
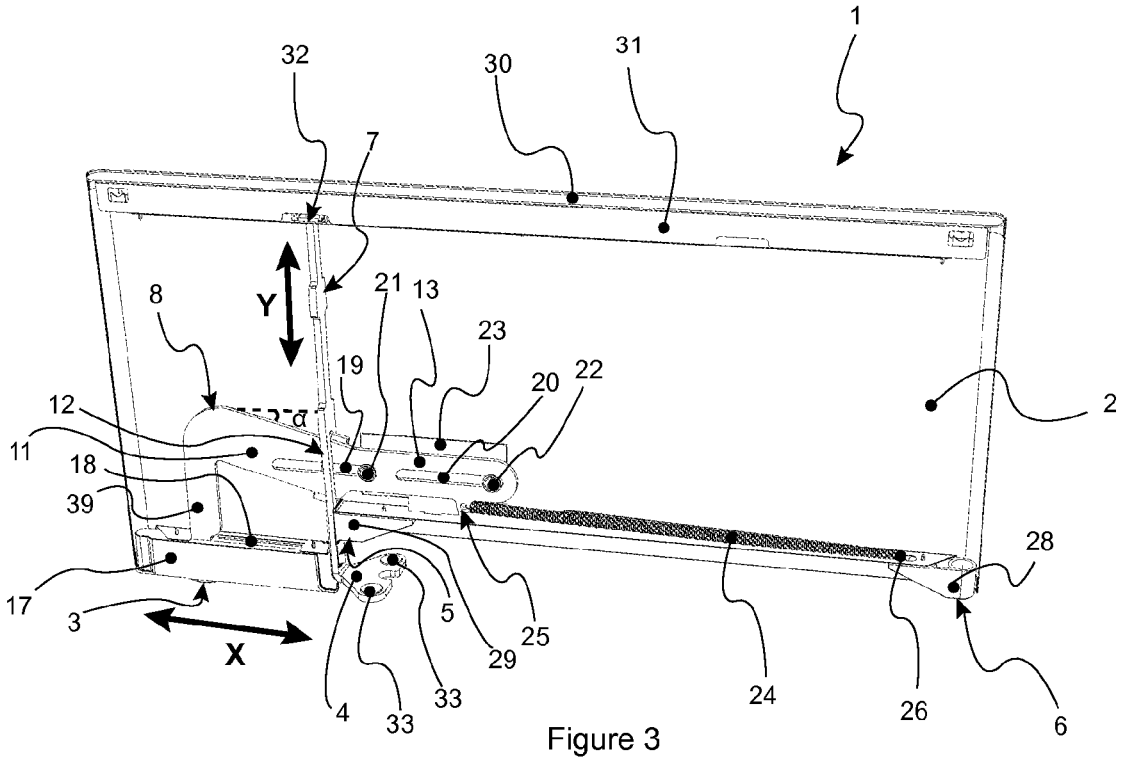
FIG. 3 illustrates the attachment device with the actuating member in the maximum actuating position.
Figure 4:
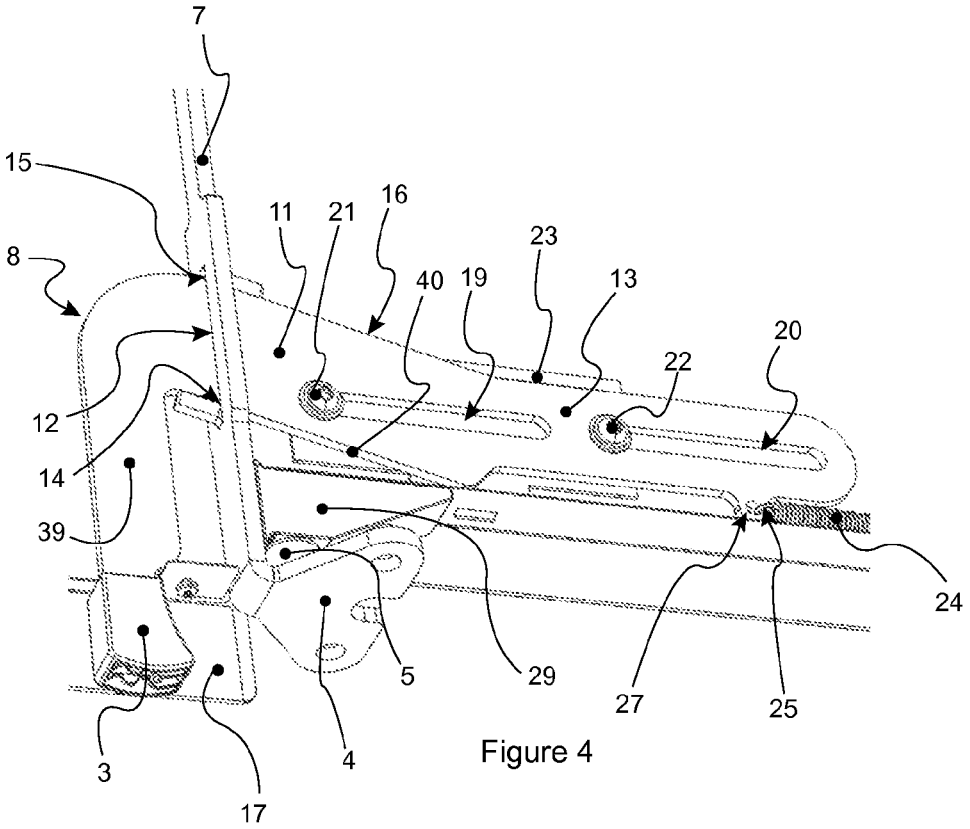
FIG. 4 is an enlarged view of the attachment device.

The attachment device per the invention is illustrated in FIGS. 2 to 4.

FIG. 2 makes reference to FIG. 1*a*, with the actuating member (8) in the maximum release position and the flange (7) raised, while FIG. 3 makes reference to FIG. 1*b* with the actuating member (8) in the maximum actuating position and the flange (7) lowered.

The (7) vertical flange is movable in vertical translation along an axis parallel to the (Y) axis, bringing its placement end (4), bent at 90° with respect to the flange (7), away from or against the underside of the work surface (9). The actuating member (8) is movable in horizontal translation along an axis parallel to the (X) axis, between a maximum actuating position (sleeve (3) at the left) and a maximum release position (sleeve (3) at the right).

The actuating member (8) and the flange (7) are arranged such that the horizontal movement of the actuating member (8) is transformed into the vertical movement of the flange (7).

More precisely, the actuating member (8) features a ramp (11) inclined at an angle of $\alpha=]0; \pi/2[$ with respect to the horizontal and inserted inside of an opening (12) of the flange (7) in which it slides. The opening (12) is sized to receive the ramp (11) in a fitted manner, with a slight working clearance to allow sliding between the two parts. The ramp (11) is uniform in width.

Specifically, when the actuating member (8) is actuated, the ramp (11) is displaced by a horizontal movement with respect to the flange (7) which remains fixed horizontally and moves vertically along the ordinate of the inclination of the ramp (1).

When the actuating member (8) is moved from a release position (in FIG. 2) towards an actuating position (in FIG. 3), i.e., from the right towards to the left, the lower edge (40) of the ramp (11) slides and rests on the lower edge (14) of the opening (12) so as to cause the flange (7) to descend. In the reverse case, from the left towards the right, it is the upper edge (16) of the ramp (11) which slides and rests on the upper edge (15) of the opening (12) so as to cause the flange (7) to rise.

The flange (7) presents a larger section at the opening (12) to reinforce its mechanical strength in this area of high stress.

The actuating member (8) is composed principally of three parts:

A vertical part (39) sliding horizontally in a groove (18) made in a lower fixed support (17) of the panel (1), with the gripping sleeve (3) being attached at its free end;

The ramp (11) sliding in the opening (12) of the flange (7);

A horizontal part (13) provided with two horizontal slides (19, 20) inside of which are inserted bolts (21, 22) belonging to an intermediate support (23) attached to one facing plate (2) of the panel (1).

Figure 6:
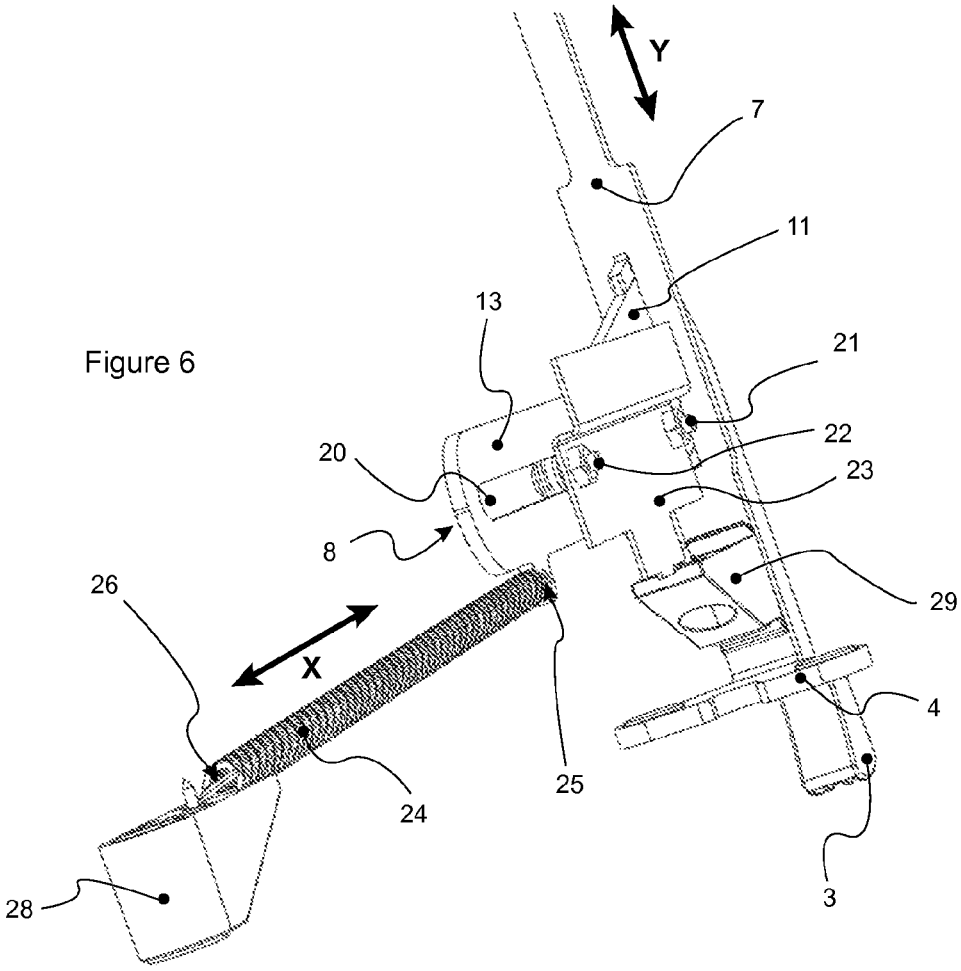
FIG. 6 illustrates the attachment device viewed from another angle.

When the actuating member (8) is displaced horizontally, the position of the bolts (21, 22) varies within the slides (19, 20). These bolts (21, 22) and the slides (19, 20) perform the translational guidance and ensure the horizontality of the actuating member (8) in any position. The arrangement of the bolts (21, 22) between the intermediate support (23) and the part (13) of the actuating member (8) is visible in FIG. 6.

Furthermore, the length of the slides (19, 20) corresponds largely to the length of the groove (18) of the lower support (17). As a result, the ends of the slides (19, 20) and/or of the groove (18) can be considered as stops limiting the movement of the actuating member (8).

A spring (24) allows the actuating member (8) to be returned from an actuating position to a release position. This spring (24) thus brings the actuating member (8) towards the right. In order to do this, the spring (24) features a first end (25) attached to the actuating member (8), or more precisely to an opening made in a spur (27) protruding from the actuating member (8), and a second end (26) attached to a fixed element of the panel (1), or more precisely to a mount (28) attached to the panel (1) at its lower right corner.

The bottom surface of this mount (28) corresponds to the supporting surface (6) mentioned previously.

Generally, the two facing panels (2) forming the front and rear faces are connected by the lower support (17), the mount (28), an upper support (31) and another mount (29).

This mount (29) is arranged symmetrically to the mount (28) at the level of the angle formed by the extension (10) of the panel (1). The lower surface of this mount (29) corresponds to the previously mentioned supporting surface (5). It is located across from the placement end (4) of the flange (7). All of the supporting surfaces on the work surface (9), namely surfaces (5, 6) and the upper surface of the placement end (4), are provided with non-slip feet (33) visible in FIGS. 2 and 3.

The upper support (31) extends over the entire length of the panel (1), and features an opening (32) inside of which the upper part of the flange (7) is inserted. This opening (32) thus also serves to guide the flange (7) at the time of its vertical movement. The flange (7) is also guided at its bottom portion between a vertical side of the lower support (17) and a vertical side of the mount (29), with these two sides coming to surround the lower part of the flange (7) located in the angle of extension (10) of the panel (1).

Figure 5:
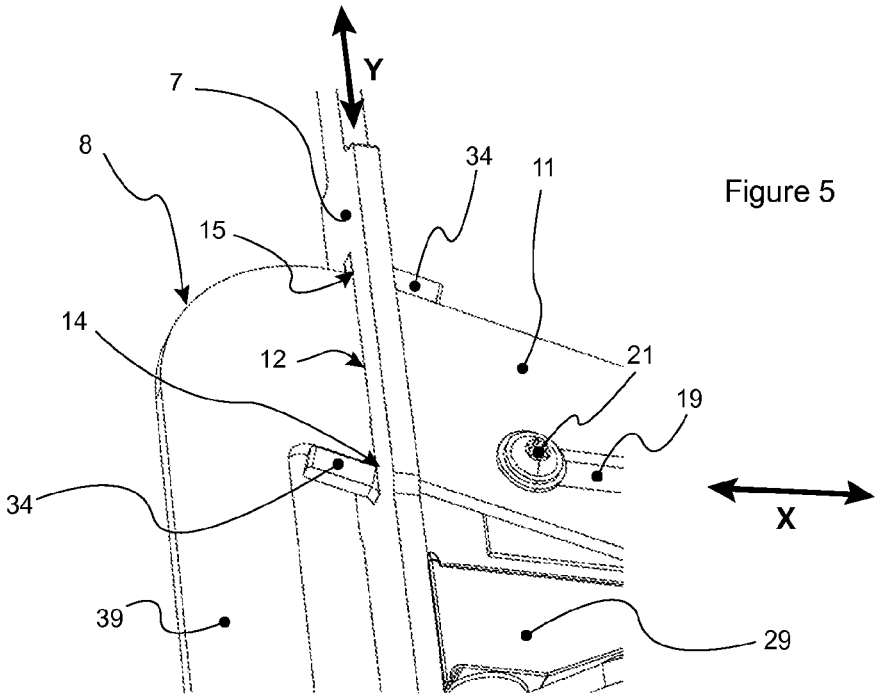
FIG. 5 shows the insertion of the ramp in the flange.

FIG. 5 shows precisely the insertion of the ramp (11) in the opening (12) of the flange (7). Advantageously, guiding fins (34) of the ramp (11) are provided at the top and bottom edges of the opening (12) of the flange (7). They offer a larger sliding surface between the ramp (11) and the flange (7), thus improving the sliding of the actuator member (8).

In the present case, these fins (34) correspond to the material removed from the flange in order to form the opening (12). They are in fact simply cut out and then bent at an angle α corresponding to the angle of inclination of the ramp (11).

Figure 7:
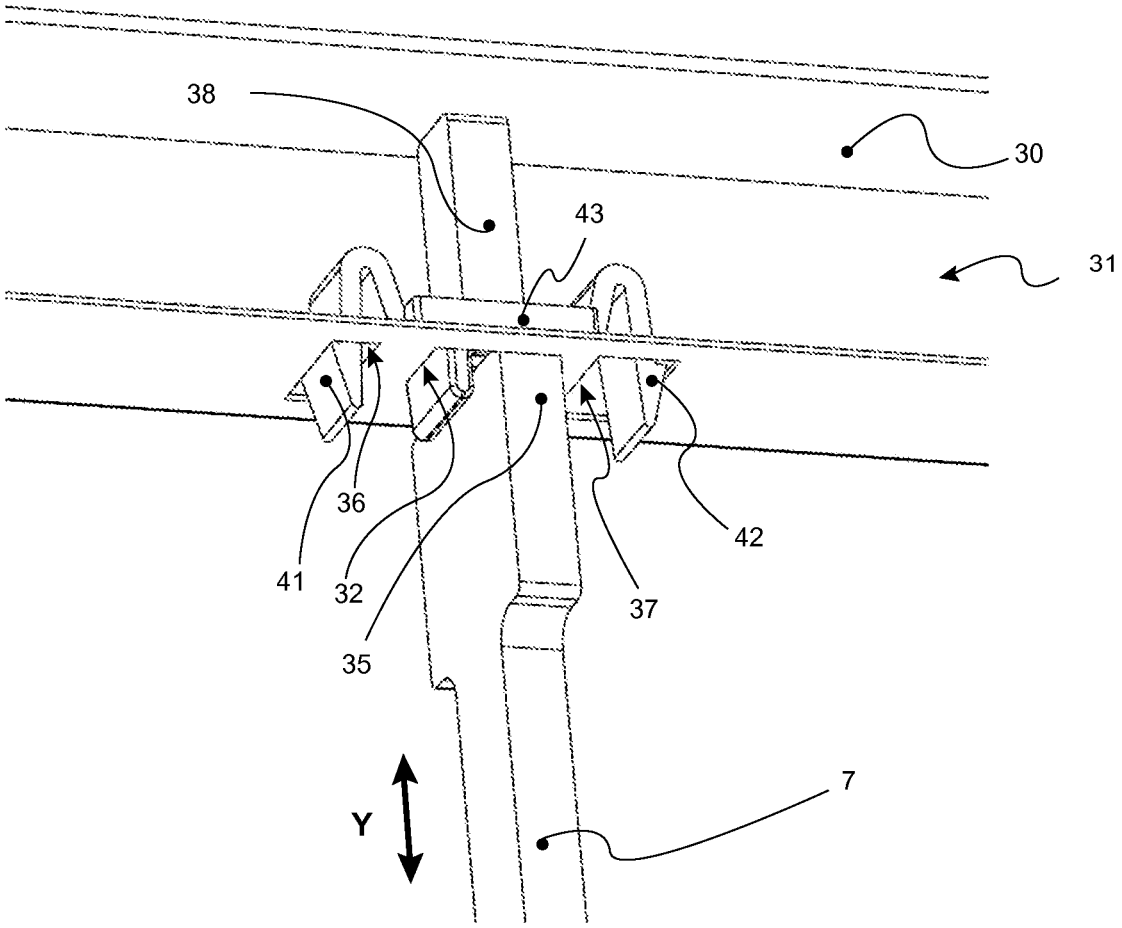
FIG. 7 is an enlarged view of the centering device of the flange.

Finally, FIG. 7 illustrates the insertion of the upper part of the flange (7) in the guiding opening (32) made in the upper support (31) of the panel (1). The flange (7) features an enlarged portion (35) with respect to its upper end (38), and of a width greater than the width of the opening (32). This enlarged portion (35) is located under the opening (32) and forms a shoulder acting as a stop to limit the upward displacement of the flange (7). This shoulder is located on the flange (7) in such a way that, when it is stopped with respect to the opening (32), the upper end (38) of the flange (7) remains under the finishing cover (30) of the upper support (31) of the panel (1).

A centering clip (43) of the flange (7) can be inserted in the guiding opening (32).

FIG. 7 shows a possible example of clip (43). It is comprised of a central portion inserted in the opening (32) and of two arms equipped with tenons (41, 42) capable of being clipped in the two openings (36, 37) located on either side of the opening (32). The central portion of the clip (43) features a through hole sized to receive the upper end (38) of the flange (7) in a fitted manner, with a slight working clearance to allow its vertical displacement. The tenons (41, 42) act as a stop to prevent any upward movement of the clip (43), while the central portion features an overhang capable of pressing against the upper surface (31) to prevent any downward movement of the clip (43). The clip (43) is therefore held firmly in position.

Of course, the example above should not be regarded as exhaustive of the invention, which instead includes the set of variants of shape and configurations that are within the reach of ordinary skill in the art.

The invention claimed is:

1. A space dividing panel assembly comprising:

a panel having a lower edge that is configured to rest on a top surface of a work surface;

an attachment device configured to attach the panel to a work surface, the attachment device comprising:

a movable branch portion forming with the lower edge of the panel a clamp mechanism configured to be disposed on opposite sides of an external overhang of a work surface, wherein the movable branch portion is configured to move between a position in which it presses against an underside of a work surface to attach the panel to a work surface, and a position at a distance from the underside for releasing the panel; and a movable actuating member located within the panel, the movable actuating member being configured to move in a direction running parallel to a work surface to control a displacement and a position of the movable clamp portion relative to a work surface.

2. A space dividing panel assembly comprising:

a panel having a lower edge that is configured to rest on a top surface of a work surface;

an attachment device configured to attach the panel to a work surface, the attachment device comprising:

a movable branch portion forming with the lower edge of the panel a clamp mechanism configured to be disposed on opposite sides of an external overhang of a work surface, wherein the movable branch portion is configured to move between a position in which it presses against an underside of a work surface to attach the panel to a work surface, and a position at a distance from the underside for releasing the panel;

a movable actuating member configured to move in a direction running parallel to a work surface to control a displacement and a position of the movable clamp portion relative to a work surface;

wherein the movable branch portion comprises a vertical flange having a placement end that is angled at 90° with respect to the vertical flange, wherein the vertical flange is mobile in vertical translation to bring the placement end away from or against an underside of a work surface in order to respectively release the panel or to attach the panel to a work surface;

and wherein the actuating member is mobile in horizontal translation between an actuating position at a distance from a work surface where the placement end of the vertical flange is at a distance from a work surface, and a releasing position in a vicinity of a work surface where the placement end of the vertical flange rests against an underside of a work surface, wherein the actuating member is configured to be returned from the actuating position to the release position; and wherein horizontal movement of the actuating member causes vertical movement of the flange.

3. The space dividing panel assembly of claim 2, wherein:

the vertical flange includes an opening;

the actuating member includes a ramp that is inclined at an angle of $\alpha=]0; \pi/2[$ with respect to the horizontal, wherein the ramp is disposed in the opening in the vertical flange whereby horizontal displacement of the ramp causes the vertical displacement of the vertical flange.

4. The space dividing panel assembly of claim 3, wherein:

the actuating member is movably guided within the space dividing panel.

5. The space dividing panel assembly of claim 4, including:

slide links that movably guide the actuating member.

6. The space dividing panel assembly of claim 5, wherein:

the actuating member includes:

a vertical part sliding horizontally in a groove in a fixed lower support of the panel; and a horizontal part provided with at least one horizontal slide inside of which at least two bolts of a fixed intermediate support of the panel are inserted, with the position of the bolts within the slide dependent on the horizontal movement of the actuating member.

7. The space dividing panel assembly of claim 6, wherein:

the vertical flange includes guiding fins that are angled at a same angle α with respect to the horizontal.

8. The space dividing panel assembly of claim 7, wherein:

the vertical flange is movably guided within the panel.

9. The space dividing panel assembly of claim 8, wherein:

the panel includes an upper support having a guiding opening, a lower support having a vertical side, and a fixed element having a vertical side;

an upper part of the vertical flange traverses the guiding opening in the upper support of the panel, and wherein a lower part of the flange is guided on either side between the vertical side of a lower support of the panel and the vertical side of the fixed element of the panel.

10. The space dividing panel assembly of claim 9, wherein:

the vertical flange includes a centering clip that is inserted in the guide opening of the upper support of the panel.

11. The space dividing panel assembly of claim 10, wherein:

the vertical flange includes a shoulder in its upper part acting as a stop with respect to the upper support of the space dividing panel and limiting vertical displacement of the vertical flange towards the top of the panel.

12. The space dividing panel assembly of claim 11, including:

a spring having a first end attached to the actuating member and a second end attached to the fixed element of the panel to generate a return force acting on the actuating member.

13. The space dividing panel assembly of claim 12, wherein:

the panel includes two facing plates forming front and rear faces, the two facing plates being connected by the upper support and the lower support, and by first and second mounts arranged symmetrically at a lower portion of the panel to contact a work surface, wherein the bottom surfaces of the first and second mounts are configured to engage a work surface.

14. The space dividing panel assembly of claim 13, wherein:

the first mount is located facing the placement end of the vertical flange.

15. The space dividing panel assembly of claim 14, wherein:

the first mount constitutes the fixed element of the panel of which one of the vertical sides serves to guide the vertical flange.

16. The space dividing panel assembly of claim 15, wherein:

the second mount constitutes the fixed element of the panel to which the second end of the spring is connected.

17. The space dividing panel assembly of claim 16, wherein:

the supporting surfaces of the panel include non-skid feet.

18. The space dividing panel assembly of claim 17, wherein:

the free end of the vertical part of the actuating member includes a gripping sleeve extending from the lower support for manual actuating of the actuating member by a user.

19. A combination work surface and space dividing panel assembly comprising:

a work surface having an external overhang having opposite sides, a top surface, and an underside;

a panel having a lower edge resting on the top surface of the work surface;

an attachment device attaching the panel to the work surface, the attachment device comprising:

a movable branch portion forming with the lower edge of the panel a clamp mechanism disposed on the opposite sides of the external overhang of the work surface, wherein the movable branch portion moves between a position in which it presses against the underside of the work surface and attaches the panel to the work surface, and a position at a distance from the underside to release the space dividing panel from the work surface; and a movable actuating member located within the panel, the movable actuating member moving in a direction running parallel to the work surface to control a displacement and a position of the movable clamp portion relative to the work surface.

20. A space dividing panel assembly comprising:

a panel having a lower edge that is configured to rest on a top surface of a work surface;

an attachment device configured to attach the panel to a work surface, the attachment device comprising:

a movable branch portion forming with the lower edge of the panel a clamp mechanism configured to be disposed on opposite sides of an external overhang of a work surface, wherein the movable branch portion is configured to move between a position in which it presses against an underside of a work surface to attach the panel to a work surface, and a position at a distance from the underside for releasing the panel; and a movable actuating member configured to move in a direction running parallel to a work surface to control a displacement and a position of the movable clamp portion relative to a work surface, and wherein the movable branch portion is biased towards the position in which it presses against an underside of a work surface.

21. The space dividing panel assembly of claim 20, wherein:

the panel includes a fixed element, and including:

a spring having a first end attached to the actuating member and a second end attached to the fixed element of the panel to generate a return force acting on the actuating member to thereby bias the movable branch portion towards the position in which is presses against an underside of a work surface.

* * * * *